United States Patent [19]

Bales

[11] Patent Number: 4,526,332

[45] Date of Patent: Jul. 2, 1985

[54] CONTROL PANEL CLOCK LENS ARRANGEMENT

[75] Inventor: Michael E. Bales, New Palestine, Ind.

[73] Assignee: The Maytag Company, Newton, Iowa

[21] Appl. No.: 621,851

[22] Filed: Jun. 18, 1984

[51] Int. Cl.[3] ..... G12B 9/00

[52] U.S. Cl. ..... 248/27.1; 73/431; 200/38 FA; 219/452; 126/273 R; 126/19 R

[58] Field of Search ..... 368/10, 88, 107–109; 73/431; 200/38 FA; 248/27.1; 126/273 R, 273 A; 219/452; 126/19 R

[56] References Cited

U.S. PATENT DOCUMENTS

| | | | |
|---|---|---|---|
| 3,759,032 | 9/1973 | Bassett et al. | 368/108 |
| 3,909,565 | 9/1975 | Clouser et al. | 200/38 FA |
| 4,037,398 | 7/1977 | Flumm et al. | 368/108 |
| 4,287,583 | 9/1981 | Strachan et al. | 368/10 |
| 4,431,907 | 2/1984 | Barnett | 219/452 |

*Primary Examiner*—Carroll B. Dority, Jr.
*Attorney, Agent, or Firm*—Richard L. Ward

[57] ABSTRACT

A control panel is provided for a household appliance which includes a clock-timer lens which is effectively sealed to the rear of the control panel assembly. The integral clock-timer lens and control panel combine to prevent the infiltration of soil into the face of the clock-timer. The assembly is simple to clean without soil particles dropping into the face of the clock-timer.

11 Claims, 4 Drawing Figures

CONTROL PANEL CLOCK LENS ARRANGEMENT

BACKGROUND OF THE INVENTION

This invention relates generally to the field of control panels for appliances and in particular to a control panel for a domestic range or stove which includes a clock-timer lens insert integrally associated with the control panel assembly.

In the appliance industry and in particular the domestic range industry, previous design practice has been to utilize clock-timer assemblies which are factory preassembled, including a glass lens or front, and which are then front mounted to the control panel by snapping the clock-timer assembly into a preformed opening in the control panel. The clock-timer assemblies are generally complete with a chrome bezel trim surrounding the clock-timer lens.

There are also control panel assemblies in which a clock-timer assembly is mounted behind the control panel. These control panel assemblies usually have a separate, forwardly spaced plastic or glass front panel overlay which includes the descriptive nomenclature pertaining to the various control dials.

All of the previously known appliance control panels present numerous edges, openings and cracks which provide potential areas for trapping grease, moisture and spilled cooking products. These prior art control panels and the clock-timer lens areas are therefore particularly difficult to keep clean because of these edges, openings, etc., and are subject to infiltration of soil into the face of the clock-timer. This soil infiltration will also form a film on the inside surface of the clock-timer lens.

The present invention provides an improvement over the known prior art constructions by means of a control panel assembly which has a clock-timer lens which is effectively sealed to the rear of an opening in the control panel. The sealing engagement of the clock-timer lens to the control panel opening provides a lens mounting area which is essentially free from soil trapping open edges, cracks and sharp corners.

SUMMARY OF THE INVENTION

It is therefore an object of the instant invention to provide an improved clock-timer lens arrangement integrated into a control panel.

It is a further object of the instant invention to provide a clock-timer lens arrangement which is simple to clean.

It is a still further object of the instant invention to provide a clock-timer lens arrangement which inhibits soil infiltration into the face of the clock-timer.

Briefly, the instant invention achieves these objects in an appliance control panel having an improved clock-timer lens mounting arrangement. The control panel defines an opening for displaying the face of an appliance clock-timer. A lens is provided for closing the opening in the control panel. Bracketry secures the appliance clock-timer and the lens behind the opening in the control panel and includes structure for clamping the clock-timer and the lens to the rear of the opening with the lens in a generally contiguous sealing association to the control panel around the opening to provide a clock-timer lens mounting arrangement in which the control panel at the periphery of the opening is effectively sealed to the lens without auxiliary decorative frames. The clock-timer lens mounting arrangement thus prevents soil infiltration from the environment of the face of the control panel onto the face of the clock-timer.

Operation and construction of the mounting arrangement for the clock-timer lens and further objects and advantages thereof will become evident as the description proceeds and from an examination of the accompanying two sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
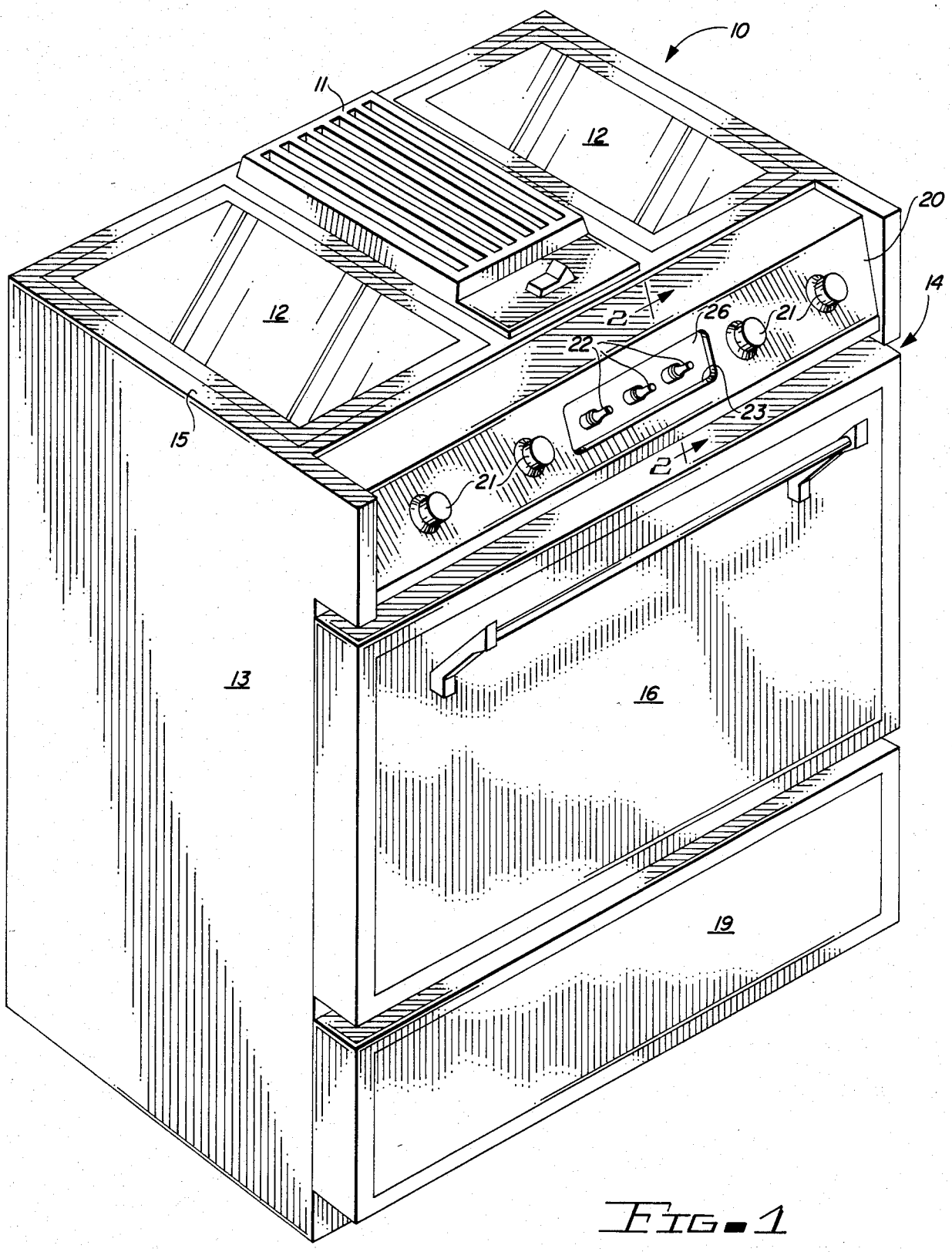
FIG. 1 is a pictorial view of a free-standing proximity ventilated range.

Referring now to the drawings and in particular to FIG. 1, there is shown a free-standing range or stove 10 of the type incorporating proximity ventilation with a centrally located air intake 11. The range 10 shown in FIG. 1 utilizes interchangeable plug-in modular cooktop cartridges 12. These interchangeable cooktop cartridges 12 are generally illustrated as smooth cooktop units in FIG. 1 but can also include a variety of cooking accessories as well as conventional heating elements.

The range 10 as shown in FIG. 1 includes a generally rectangular cabinet having substantially vertically disposed side and front panels 13 and 14 and a generally horizontally disposed top surface 15. The cabinet portion generally designated as front panel 14 is comprised of a forwardly opening oven door 16 and a forwardly opening access door 19 which is disposed directly below the oven door 16. Also, generally associated with the front panel 14 is a control panel 20 which includes a plurality of knobs 21 and dials 22 for providing individual control and operation of the cooktop cartridges 12 and the oven.

Figure 2:
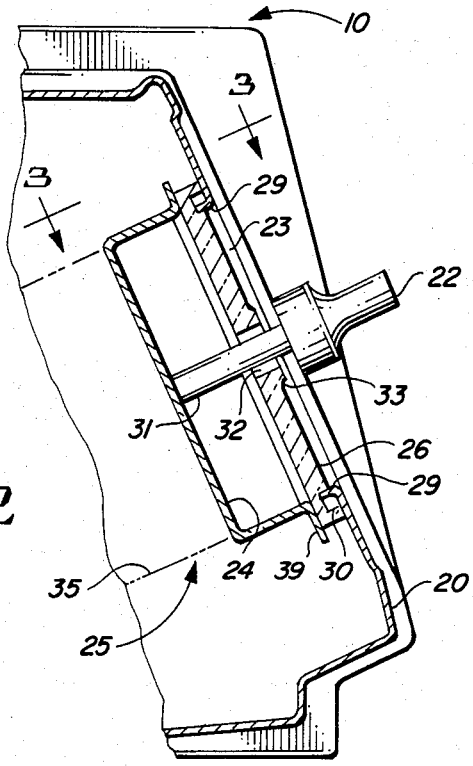
FIG. 2 is a fragmentary section view taken through the control panel of the range of FIG. 1 generally along lines 2—2.

The fragmentary section View of FIG. 2 best illustrates that the control panel 20 of the free-standing range 10 shown in FIG. 1 is angularly offset from the vertical plane of the front panel 14 of the range 10. This offset posture allows the descriptive nomenclature associated with the various knobs and dials 21 and 22 of the control panel 20 to be easily read by the operator and provides for easy manipulation of the knobs and dials 21 and 22. In this embodiment of the invention, the angle of inclination of the control panel 20 from the vertical plane of the front panel 14 is approximately 25°.

The control panel 20 is formed from sheet metal and includes a generally centrally located rectangular opening 23, as best shown in FIG. 1, for displaying the face 24 of the clock-timer 25. The rectangular opening 23 receives a transparent clock-timer lens 26, formed from a polycarbonate material in this embodiment, which protects the face 24 of the clock-timer 25. The rectangular opening 23 in the control panel 20 has a peripheral flange 29 which extends rearwardly as shown in FIGS. 2 and 3.

Figure 3:
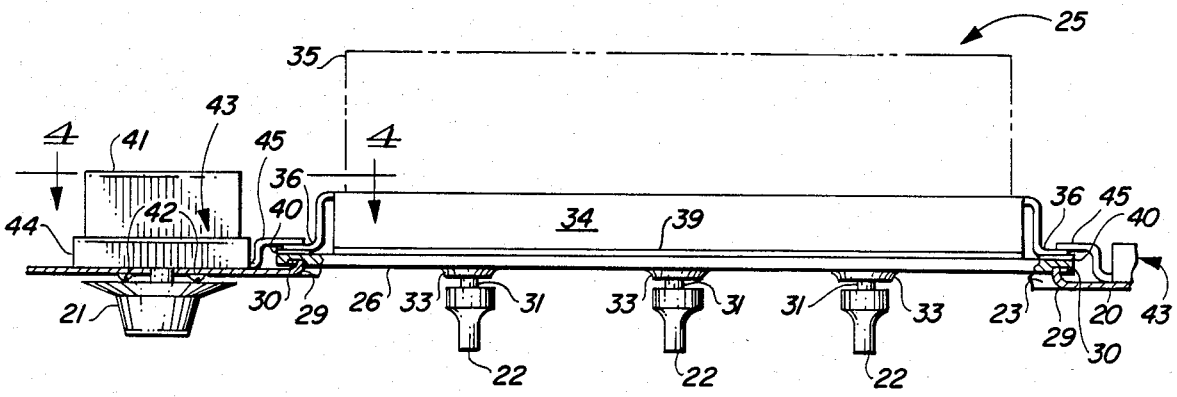
FIG. 3 is a fragmentary section view taken generally along lines 3—3 of FIG. 2.

As FIGS. 2 and 3 indicate, the clock-timer lens 26 is engaged with the rearwardly extending peripheral flange 29 of the rectangular opening 23. The forwardly facing surface of the clock-timer lens 26 has a peripheral groove 30 adjacent the perimeter of the outer edge which forms a cavity for receiving the rearwardly extending peripheral flange 29 of the rectangular opening 23. The assembled combination of the peripheral groove 30 in the clock-timer lens 26 and the rearwardly extending peripheral flange 29 of the rectangular opening 23 provide an edge seal around the juncture of the rectangular opening 23 and the clock-timer lens 26 which effectively prevents infiltration of soil into the face 24 of the clock-timer 25. It is noted that while this embodiment of the invention utilizes a substantially rectangular opening 23 and mating clock-timer lens 26, it is understood that any geometric configuration of clock-timer lens and opening could be utilized.

As further shown in FIGS. 2 and 3, the clock-timer 25 in this particular embodiment of the invention includes a plurality of adjustment and/or time setting shafts 31 which extend through apertures 32 in the clock-timer lens 26 and receive dials 22 for manually adjusting the clock-timer 25. The apertures 32 in the clock-timer lens 26 each have a raised circular boss 33 formed on the surface of the clock-timer lens 26. These circular bosses prevent grease or condensate from running down the inclined face of the clock-timer lens 26 and directly through an aperture 32 onto the face 24 of the clock-timer 25.

The mounting bracket 34 for the clock-timer 25 and the clock-timer lens 26 are secured to the rear of the control panel 20 over the rectangular opening 23 in a layered or stacked arrangement As shown in FIGS. 2 and 3, the clock-timer operating mechanism is generally depicted by phantom lines 35 and is attached to the flanged mounting bracket 34. The mounting bracket 34 includes a pair of end flanges 36 and top and bottom flanges 39. The top and bottom flanges 39 are in direct bearing contact with the rear of the clock-timer lens 26. The end flanges 36 are spaced away from the rear of the clock-timer lens 26 and a cushion pad 40 is placed between each end flange 36 and the rear of the clock-timer lens 26 as best shown in FIG. 3.

Figure 4:
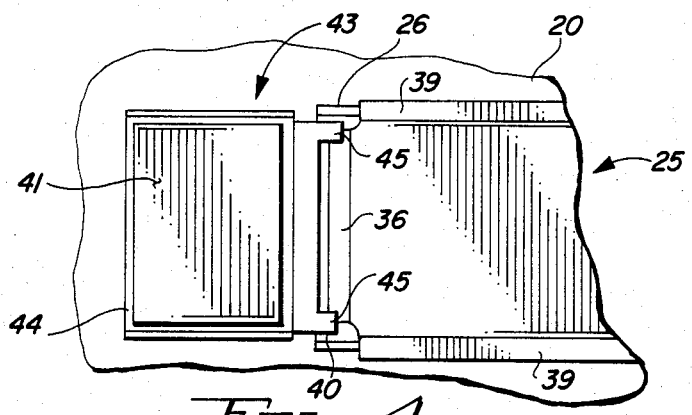
FIG. 4 is a view taken generally along lines 4—4 of FIG. 3.

Referring now to FIGS. 3 and 4, there is shown one of the plurality of control switches 41 which are secured to the control panel 20 by means of a pair of screws 42. The screws 42 are driven into a pair of tapped holes (not shown) in the body of the control switch 41 from the front of the control panel 20. It is noted that a control switch 41 is located adjacent each side of the rectangular opening 23 in the control panel 20.

As further shown in FIGS. 3 and 4, a lens securing bracket 43 is captured between the body of the control switch 41 and the rear of the control panel 20 as a control switch 41 is secured to the control panel 20 on each side of the rectangular opening 23. This lens securing bracket 43 is generally rectangular in shape and includes a substantially flat body portion 44 between the rear of the control panel 20 and the body of the control switch 41 and a pair of offset legs 45 which are engageable with the end flanges 36 of the clock-timer bracket 34. As the screws 42 for securing the body of the control switch 41 to the control panel 20 are tightened, the offset legs 45 clamp the layered arrangement of clock-timer bracket 34, cushion pad 40 and clock-timer lens 26 to the rearwardly extending peripheral flange 29 around the rectangular opening 23 in the control panel 20.

There has thus been shown in the instant invention an improved clock-timer lens arrangement for the control panel of a household appliance. The clock-timer lens and control panel peripheral flange are mutually cooperable to provide a substantially sealed joint between these two members for preventing the infiltration of soil into the face of the clock-timer. This sealed joint provides a lens arrangement which is simple to clean since there are no open joints, edges or crevices to trap soil. Further, the raised bosses formed around the shaft apertures in the transparent lens effectively prevent liquid from running down the inclined face of the lens and directly into the clock-timer face through the apertures.

In the drawings and specification, there has been set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as further defined in the following claims.

I claim:

1. An appliance control panel having an improved clock-timer lens mounting arrangement, comprising: control panel means defining an opening for displaying the face of an appliance clock-timer; lens means for closing said opening in said control panel means; and means for securing said appliance clock-timer and said lens means behind said opening in said control panel means including means for clamping said clock-timer and said lens means to the rear of said opening with said lens means in a generally contiguous sealing association to said control panel means around said opening to provide a clock-timer lens mounting arrangement in which said panel means at the periphery of said opening is effectively sealed to said lens means without auxiliary decorative frames thereby preventing soil infiltration from the environment of the face of the control panel means onto the face of said clock-timer.

2. The control panel as defined in claim 1 wherein said panel means at the periphery of said opening defines a flange and wherein said lens means is formed to receive said flange for effectively sealing said lens means to said control panel means.

3. The control as defined in claim 2 wherein said flange is rearwardly extending and said lens means includes a groove for receiving said flange.

4. The control panel as defined in claim 1 wherein said panel means around the periphery of said opening defines a flange substantially perpendicular to the plane of said opening and wherein said lens means includes a groove for receiving said flange to effectively seal said lens means to said control panel means.

5. The control panel as defined in claim 1 wherein said means for clamping includes a bracket on each side of said opening with each bracket including an off-set portion engageable with clock-trmer bracket for effectively clamping said clock-timer and said lens means to the rear of said panel means.

6. The control panel of claim 1 wherein said clock-timer means includes at least one adjustment shaft and said lens means includes an aperture permitting said adjustment shaft to extend forward of said control panel means, said lens including a raised boss adjacent said aperture for preventing liquid drainage through said aperture onto the face of said clock-timer.

7. An appliance control panel having an improved clock-timer lens mounting arrangement, comprising: control panel means defining an opening for displaying the face of an appliance clock-timer, said panel means including a rearwardly extending flange around said opening; lens means for closing said opening and including a front face formed to receive said rearwardly extending flange in a cooperative contiguous engagement to effectively seal said lens to said panel means; control means associated with said control panel means and including a switch mounted on said control panel means adjacent each vertical side of said opening; and means for securing said clock-timer and said lens means to the rear of said control panel including a bracket captured between the rear of said control panel and each of said switches, whereby said flange and lens means effectively seal said opening for preventing soil infiltration onto the face of said clock-timer.

8. The appliance control panel of claim 7 wherein said rearwardly extending flange is substantially perpendicular to the plane of said control panel and wherein said lens means includes a groove for receiving said flange.

9. The appliance control panel of claim 7 wherein said clock-timer includes at least one adjustment shaft and said lens means includes an aperture permitting said shaft to extend forward of said control panel means, said lens including a raised boss adjacent said aperture for preventing liquid drainage through said aperture onto the face of said clock-timer.

10. An appliance control panel having an improved clock-timer lens mounting arrangement, comprising: control panel means defining a rectangular opening for displaying the face of an appliance clock-timer; lens means for closing said opening in said control panel means; and means for securing said appliance clock-timer and said lens means behind said control panel means including bracket means engageable with said clock-timer for clamping said clock-timer and said lens means to the rear of said opening, said bracket means including elongated flanges engageable with said lens means adjacent the long sides of said rectangular opening to maintain said lens means in a generally contiguous sealing association to said control panel means around said opening and provide a clock-timer lens mounting arrangement in which said control panel means at the periphery of said opening is effectively sealed to said lens means without auxiliary decorative frames thereby preventing soil infiltration from the environment of the face of the control panel means onto the face of said clock-timer.

11. The appliance control panel as defined in claim 10 wherein said bracket means includes secondary flanges adjacent the short sides of said rectangular opening and wherein said control panel includes a switch mounted thereon adjacent each Vertical side of said opening in holding engagement with said secondary flange.

* * * * *